US006637606B1

(12) United States Patent
Chen

(10) Patent No.: US 6,637,606 B1
(45) Date of Patent: Oct. 28, 2003

(54) RACK FOR WRENCHES

(76) Inventor: Terence Chen, No. 325, Yung Ching Rd., Tung Shan Hsiang, Lo Tung Town, Yi Lan Hsien (TW)

( * ) Notice: Subject to any disclaimer, the term of this patent is extended or adjusted under 35 U.S.C. 154(b) by 0 days.

(21) Appl. No.: 10/195,541

(22) Filed: Jul. 16, 2002

(51) Int. Cl.[7] ..... A47F 7/00
(52) U.S. Cl. ..... 211/70.6; 206/372; 206/376
(58) Field of Search ..... 211/70.6, 89.01, 211/60.1, 69, 70.7; 206/372, 376, 377

(56) References Cited

U.S. PATENT DOCUMENTS 2,438,989 A * 4/1948 Billman
3,997,053 A * 12/1976 Bondhus ..... 206/377
4,911,297 A * 3/1990 Suburu ..... 206/376
4,997,085 A * 3/1991 Brennan ..... 206/376
D355,826 S * 2/1995 Chow
5,931,299 A * 8/1999 Hsieh ..... 206/376
6,126,004 A * 10/2000 Ling ..... 206/377
D433,613 S * 11/2000 Jialin
6,186,323 B1 * 2/2001 Jansson et al. ..... 206/376 X
6,257,409 B1 * 7/2001 Lin ..... 206/376
6,481,583 B1 * 11/2002 Black et al. ..... 211/70.6

* cited by examiner

*Primary Examiner*—Robert W. Gibson, Jr.
(74) *Attorney, Agent, or Firm*—Rosenberg, Klein & Lee

(57) ABSTRACT

A rack includes a board, a first group of holders formed on the board for holding a first group of wrenches and a second group of holders formed on the board for holding a second group of wrenches so that the first group of wrenches and the second group of wrenches are in different planes. Each of the holders of the first group includes two prongs extending from the board toward each other. Each of the holders of the second group includes a base formed on the board and two prongs extending from the base toward each other. A plurality of apertures is defined in the board corresponding to the first group of holders. A plurality of cylinders is formed on the board corresponding to the second group of holders. A fastener includes an anchor for insertion through a hole defined in one of the wrenches held via the holders and one of the apertures and the cylinders for hooking the board and a stop for abutment against the same wrench. A rail is pivotally connected with the rack at an end and includes a hook at an opposite end for hooking the rack in order to conceal the holders and further restrain the wrench.

6 Claims, 5 Drawing Sheets

RACK FOR WRENCHES

BACKGROUND OF INVENTION

1. Field of Invention

The present invention relates to a rack for wrenches.

2. Related Prior Art

Taiwan Patent Publication No. 319154 discloses a rack for wrenches. The rack 10 consists of a board 11 and a plurality of holders 14 formed on the board 11. Each holder 14 consists of two elastic prongs extending from the board 11 toward each other, thus defining a space 15 between the elastic prongs and a slit 16 between the tips of the elastic prongs. This conventional rack is capable of holding a plurality of wrenches for display. However, the wrenches can be easily removed from the rack and stolen.

The present invention is therefore intended to obviate or at least alleviate the problems encountered in prior art.

SUMMARY OF INVENTION

It is the primary objective of the present invention to provide a security device for a rack for wrenches.

According to the present invention, a rack includes a board, a first group of holders formed on the board for holding a first group of wrenches and a second group of holders formed on the board for holding a second group of wrenches so that the first group of wrenches and the second group of wrenches are in different planes.

Each of the holders of the first group may include two prongs extending from the board toward each other. Each of the holders of the second group may include a base formed on the board and two prongs extending from the base toward each other.

A plurality of apertures may be defined in the board corresponding to the first group of holders. A plurality of cylinders may be formed on the board corresponding to the second group of holders. A fastener may include an anchor for insertion through a hole defined in one of the wrenches held via the holders and one of the apertures and the cylinders for hooking the board and a stop for abutment against the same wrench.

A rail may be pivotally connected with the board at an end and may include a hook at an opposite end for hooking the board in order to conceal the holders and further restrain the wrenches.

Other objects, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF PREFERRED EMBODIMENT

Figure 1:
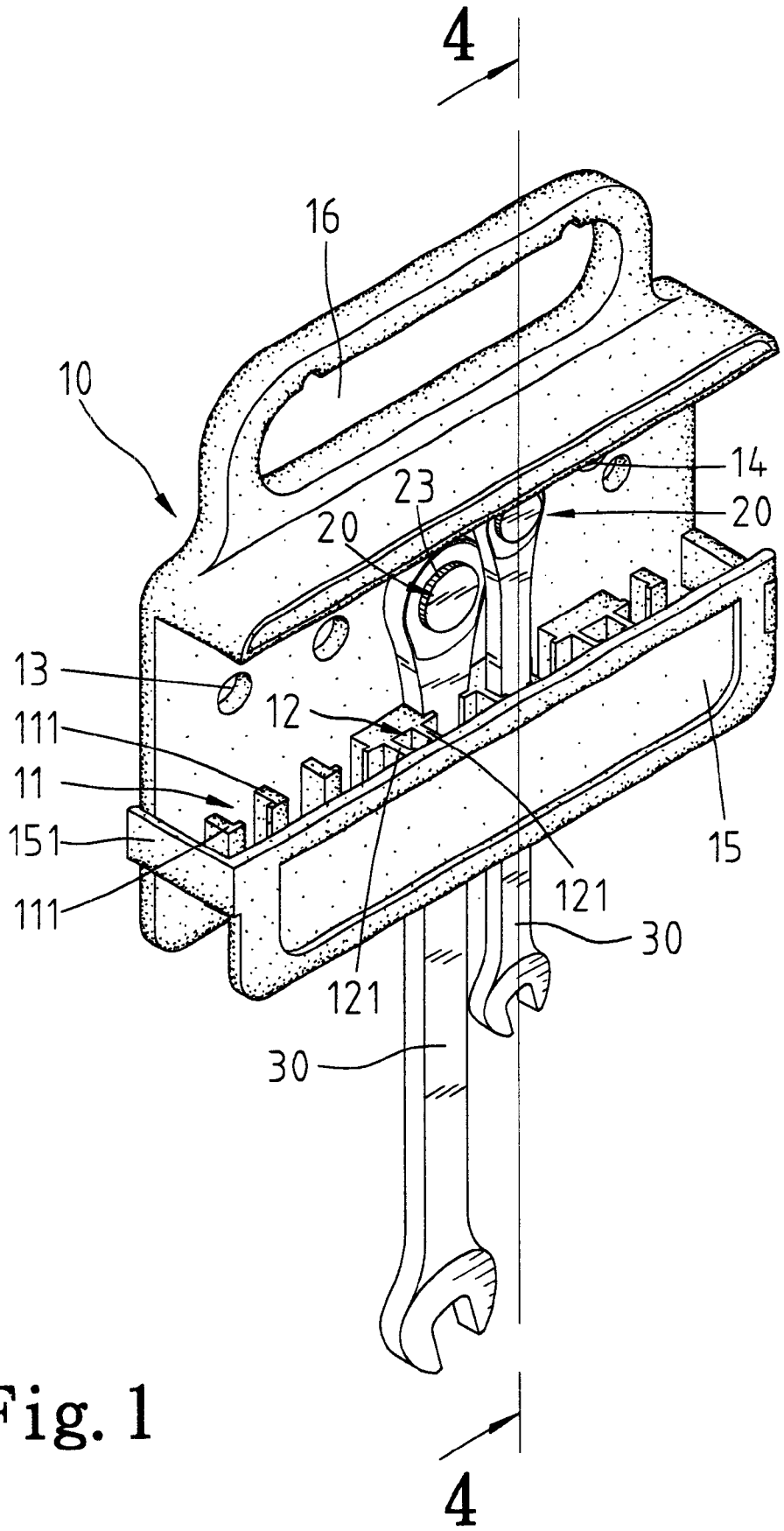
FIG. 1 is a perspective view of a rack for wrenches in a closed position according to the present invention.
Figure 2:
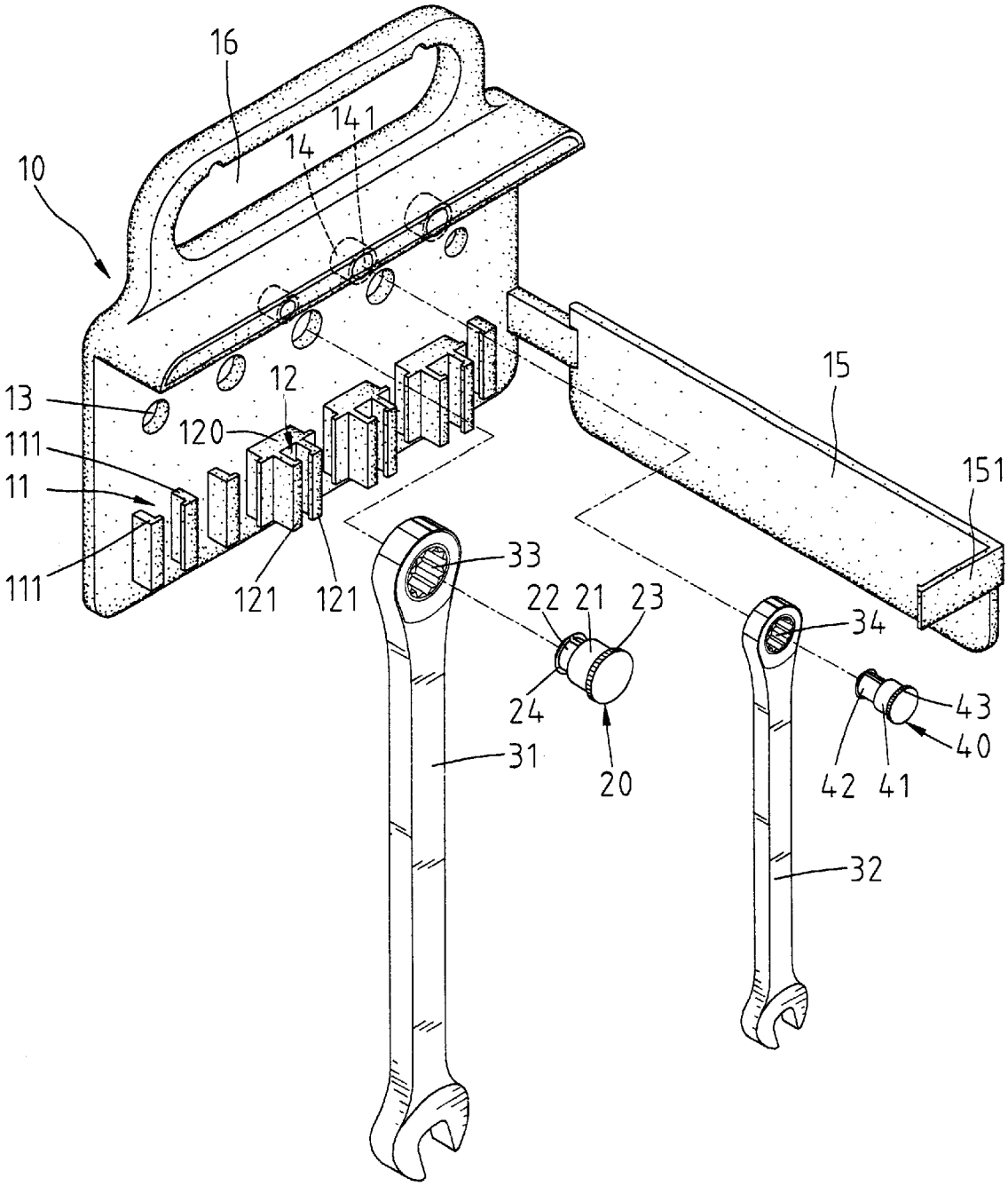
FIG. 2 is an exploded view of the rack for wrenches according to the present invention.
Figure 3:
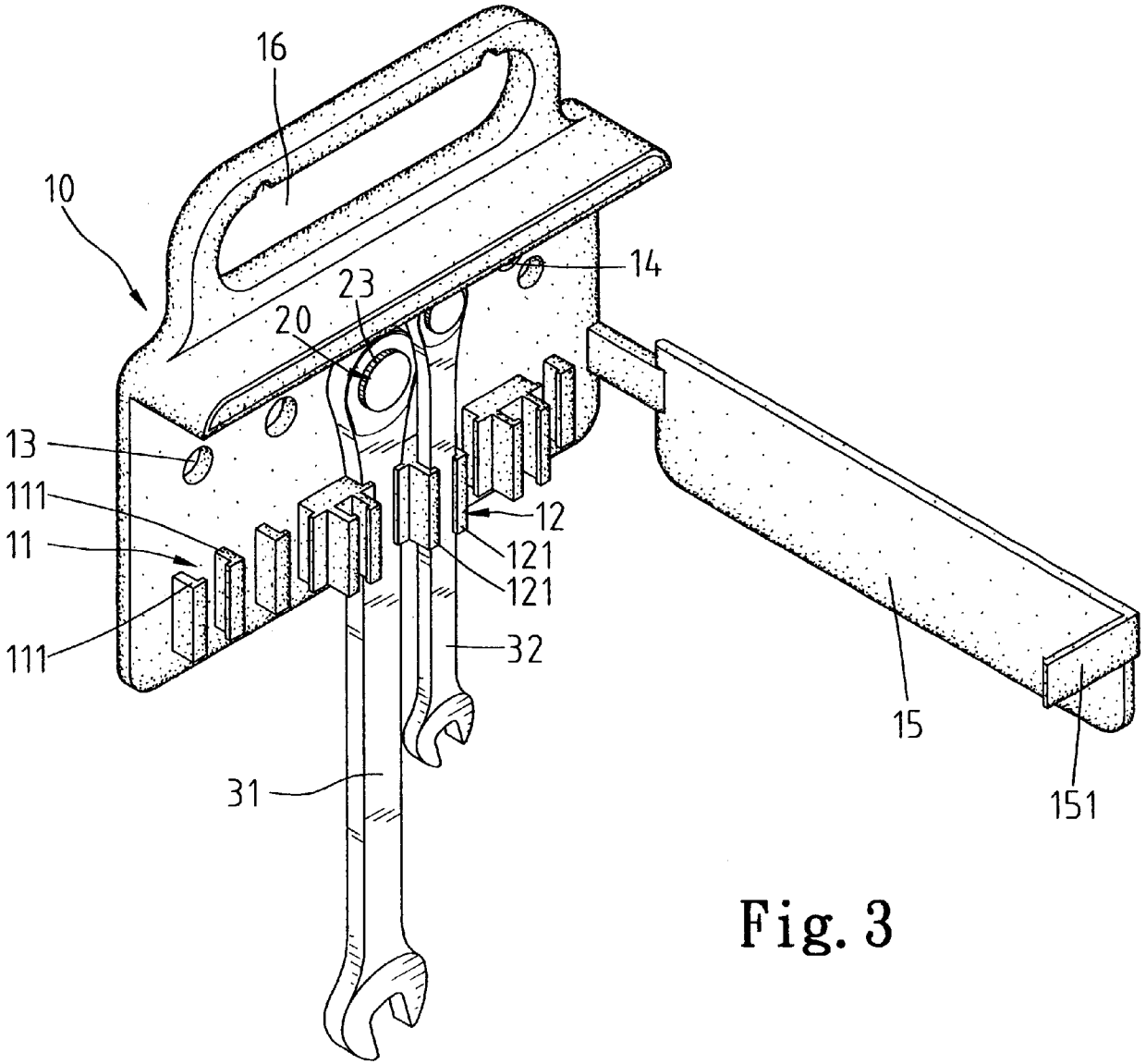
FIG. 3 is a perspective view of the rack for wrenches in an open position according to the present invention.

Referring to FIGS. 1~5, according to the present invention, a rack 10 includes a board (not numbered), a plurality of large holders 11 formed on the board and a plurality of small holders 12 formed on the board. Each of the large holders 11 includes two prongs 111 extending from the board toward each other, thus defining a space between the prongs 111 and a slit between the tips of the prongs 111. Each of the small holders 12 includes a base 120 formed on the board and two prongs 121 extending from the base 120 toward each other, thus defining a space between the prongs 121 and a slit between the tips of the prongs 121.

Figure 4:
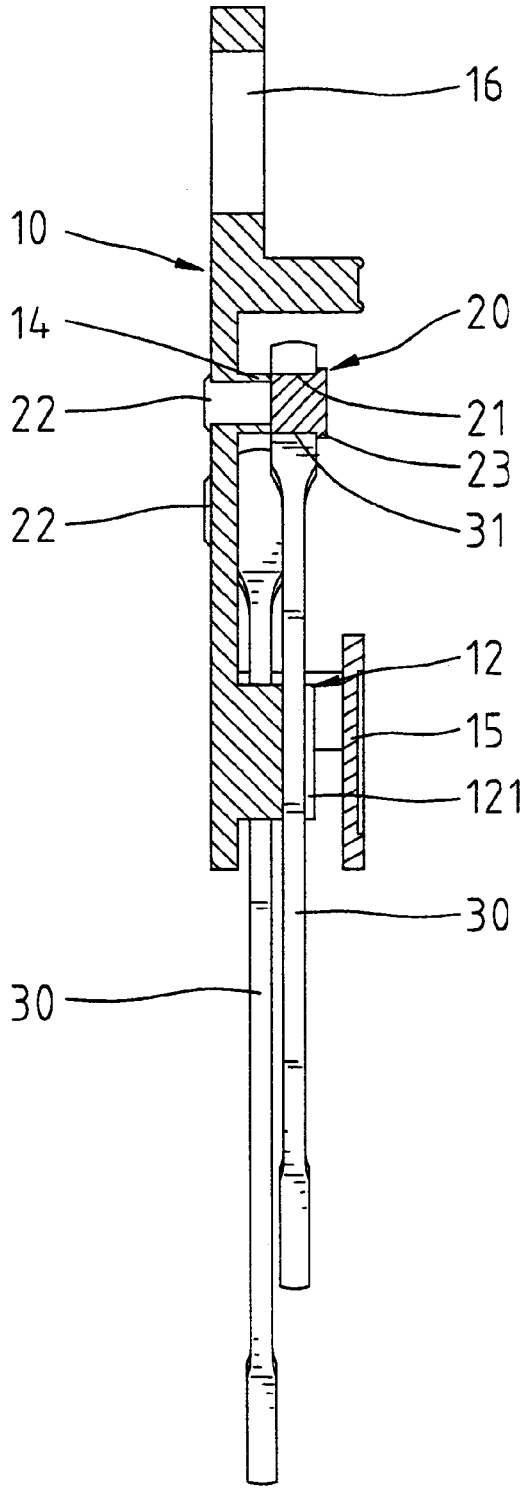
FIG. 4 is a cross-sectional view taken along a line 4—4 in FIG. 1.
Figure 5:
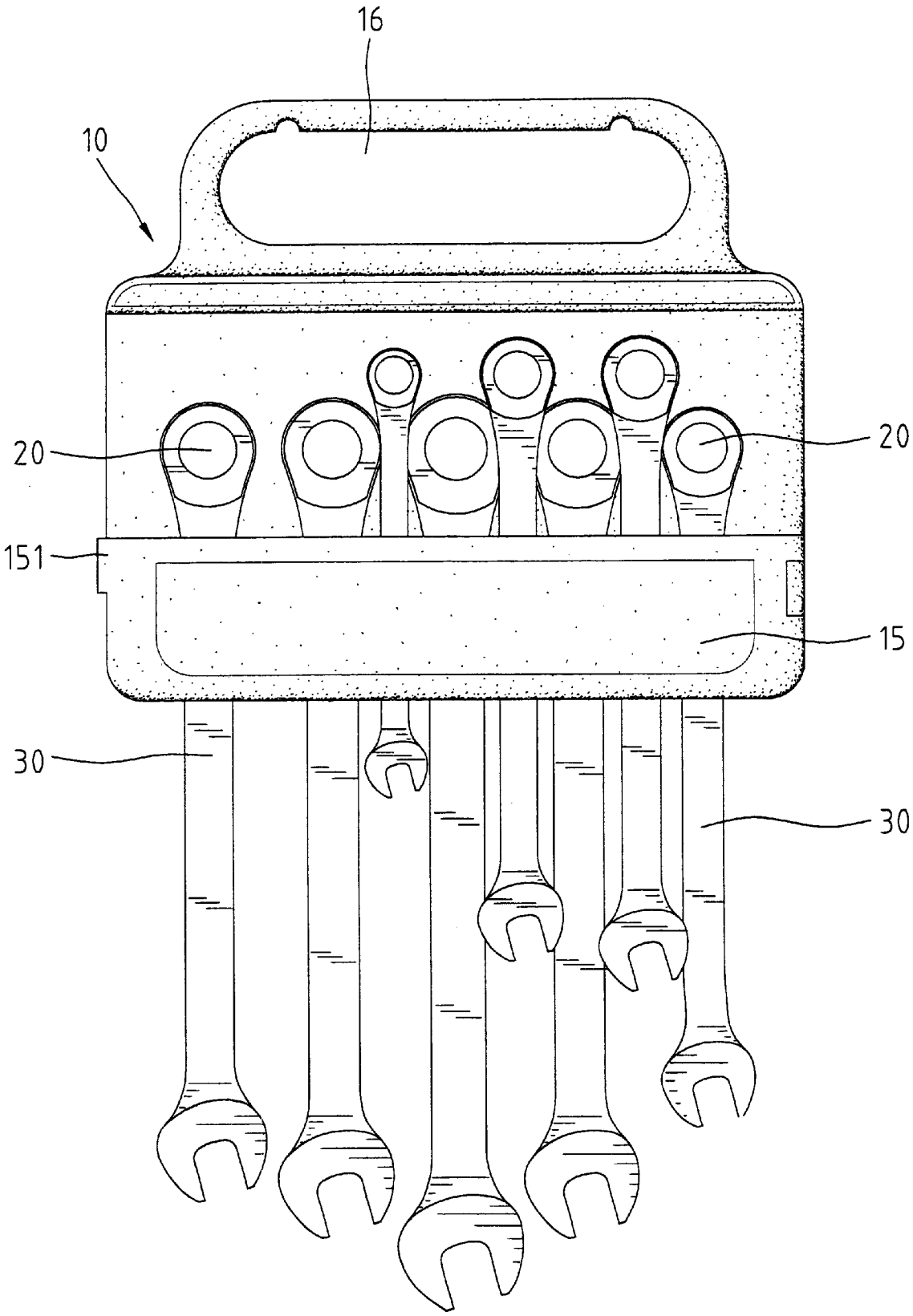
FIG. 5 is a front view of the rack for wrenches in a closed position according to the present invention.

Wrenches 31 (only one is shown in the drawings) with thick handles can be held via the large holders 11, and wrenches 31 (only one is shown in the drawing) with thin handles can be held via the small holders 12. As best shown in FIG. 4, when the wrenches 31 and 32 are mounted on the rack 10, the wrenches 31 are in a first layer and the wrenches 32 are in a second layer further from the board than the first layer. It is obvious that the wrenches 31 cannot be removed from the rack 10 unless the wrenches 32 are removed from the rack 10.

The rack 10 includes a plurality of apertures 13 defined in the board. Each of the apertures 13 is located above one of the holders 11. The rack 10 includes a plurality of cylinders 14 formed on the board. Each of the cylinders 14 defining a channel 141 is located above one of the holders 11.

The rack 10 includes a plurality of fasteners 20. Each of the fasteners 20 includes a first section 21 and a second section 22 thinner than the first section 21, a stop 23 formed on the first section 21 and an anchor 24 formed on the second section 22. The anchor 24 is in the form of a truncated cone. A slit (not numbered) may be defined in the anchor 24 for improving flexibility.

When a wrench 31 is held by means of a large holder 11, the anchor 24 and the second section 22 of a fastener 20 is inserted through an annular gear 33 of the wrench 31, and the first section 21 of the fastener 20 in the annular gear 33 of the wrench 31. The anchor 24 is pressed through a hole 13, thus hooking the board. The annular gear 33 is restrained between the board and the stop 23. Te wrench 31 is stably mounted on the rack 10 via the large holder 11 and the fastener 20.

The rack 10 includes a plurality of fasteners 40. Each of the fasteners 40 includes a first section 41 and a second section 42 thinner than the first section 41, a stop 43 formed on the first section 41 and an anchor 44 formed on the second section 42. The anchor 44 is in the form of a truncated cone. A slit (not numbered) may be defined in the anchor 44 for improving flexibility.

When a wrench 32 is held by means of a small holder 12, the anchor 44 and the second section 44 of a fastener 40 is inserted through an annular gear 34 of the wrench 32, and the first section 41 of the fastener 40 in the annular gear 34 of the wrench 32. The anchor 44 is pressed through the channel 141 of a cylinder 14, thus hooking the board. The annular gear 34 is limited between the board and the stop 43. The wrench 32 is stably mounted on the rack 10 via the small holder 12 and the fastener 40.

The fasteners 20 and 40 are identical to one another except for their sizes.

The rack 10 includes a rail 15. The rail 15 is connected with the board at an end so that the rail 15 is pivotal relative to the board. The rail 15 is formed with a hook 151 at an opposite end. The hook 151 can be engaged with the board so that the holders 11 and 12 are concealed via the rail 15 for aesthetic reasons and that the wrenches 31 and 32 are further restrained via the rail 15.

The present invention has been described through detailed illustration of the preferred embodiment. Those skilled in the art can derive many variations from the preferred embodiment without departing from the scope of the present invention. Therefore, the preferred embodiment shall not limit the scope of the present invention. The scope of the present invention is defined in the attached claims.

What is claimed is:

1. A rack (10) including a first group of holders ( 11) formed thereon for holding a first group of wrenches (31) and a second group of holders (12) formed thereon for holding a second group of wrenches (32) so that the first group of wrenches (31) and the second group of wrenches (32) are in different planes, each of the holders (11) of the first group includes two prongs (111) extending toward each other.

2. The rack (10) according to claim 1 wherein each of the holders (12) of the second group includes a base (120) formed thereon and two prongs (121) extending from the base (120) toward each other.

3. The rack (10) according to claim 1 including a number of apertures (13) defined therein corresponding to the first group of holders (11), a number of cylinders (14) formed thereon corresponding to the second group of holders (12), a first group of fasteners (20) each including an anchor (24) for insertion through a hole defined in one of the wrenches (31) held via the first group of holders (11) and one of the apertures (13) for hooking the rack (10) and a stop (23) for abutment against the same wrench (31) and a second group of fasteners (40) each including an anchor (44) for insertion through a hole defined in one of the wrenches (32) held via the second group of holders (12) and one of the cylinders (14) for hooking the rack and a stop (43) for abutment against the same wrench.

4. The rack (10) according to claim 3 wherein each of the fasteners (20; 40) includes a slit in the anchor (24; 44) for improving flexibility.

5. The rack (10) according to claim 4 wherein the first group of fasteners (20) is shorter than the second group of fasteners (40).

6. The rack (10) according to claim 1 including a rail (15) pivotally connected therewith at an end and with a hook (151) at an opposite end for hooking the rack (10) in order to conceal the holders (11; 12) and restrain the wrenches (31; 32).

* * * * *